US008508553B2

(12) United States Patent
Dodge et al.

(10) Patent No.: US 8,508,553 B2
(45) Date of Patent: Aug. 13, 2013

(54) AUTOMATIC USER VIEWING PREFERENCE

(75) Inventors: Steven P. Dodge, Sammamish, WA (US); Zheng Wang, Redmond, WA (US); Xu Chen, Renton, WA (US); Gavin Gear, Bothell, WA (US)

(73) Assignee: Microsoft Corporation, Redmond, WA (US)

( * ) Notice: Subject to any disclaimer, the term of this patent is extended or adjusted under 35 U.S.C. 154(b) by 759 days.

(21) Appl. No.: 12/469,364

(22) Filed: May 20, 2009

(65) Prior Publication Data

US 2010/0295873 A1 Nov. 25, 2010

(51) Int. Cl.
*G09G 3/36* (2006.01)

(52) U.S. Cl.
USPC ..... 345/690; 345/89; 345/77; 345/84; 345/102; 345/207

(58) Field of Classification Search
USPC ..... 345/690, 77, 84, 102, 207, 589, 590; 349/61, 62
See application file for complete search history.

(56) References Cited

U.S. PATENT DOCUMENTS 5,554,912 A 9/1996 Thayer et al.
6,618,045 B1 9/2003 Lin
6,677,924 B2 1/2004 Nakayama
6,870,529 B1 * 3/2005 Davis ..... 345/207
2003/0025711 A1 2/2003 Kuo et al.
2006/0038807 A1 2/2006 Eckhardt et al.
2006/0092182 A1 * 5/2006 Diefenbaugh et al. ..... 345/690
2007/0090962 A1 * 4/2007 Price et al. ..... 340/691.1
2007/0176870 A1 8/2007 Hung et al.
2008/0259098 A1 10/2008 Zamorsky et al.
2008/0291139 A1 * 11/2008 Hsieh ..... 345/77

OTHER PUBLICATIONS

Microsoft Corporation, Integrating Ambient Light Sensors with Windows 7 Computers: New Opportunities and Considerations for Interfacing Ambient Light Sensors with Windows (17-page brochure), http://download.microsoft.com/download/a/d/f/adf1347d-08dc-41a4-9084-623b1194d4b2/Integrating_Ambient_Light_Sensors_With_Windows.docx (Feb. 19, 2009), copyright 2009 by Microsoft Corporation.

OLX, Inc., Acer TravelMate C300 Tablet PC—Virginia Beach (9-page brochure), http://virginiabeach.olx.com/acer-travelmate-c300-tablet-pc-iid-1909094, copyright 2006-2009 OLX, Inc.

* cited by examiner

*Primary Examiner* — Abbas Abdulselam
*Assistant Examiner* — Shawna Stepp Jones

(57) ABSTRACT

A system may allow an initial viewing adjustment curve set at a factory to be adjusted by a user, and the adjustment may pull the viewing adjustment curve in a particular direction, but may not result in a multistep, jerky viewing adjustment curve. The curve of the viewing adjustment curve may remain a curve, but, through the use of regions and smoothing, the viewing adjustment curve may retain its curve design.

19 Claims, 5 Drawing Sheets

AUTOMATIC USER VIEWING PREFERENCE

BACKGROUND

This Background is intended to provide the basic context of this patent application and it is not intended to describe a specific problem to be solved.

Logically, if an electronic display is in a brighter area then it makes sense to increase the brightness or clarity of the electronic display and likewise, when an electronic display is in a dimmer environment, it makes sense to lower the brightness or clarity of the electronic display. In addition, some users like their display to be brighter or more detailed than other users. Viewing adjustments have been available but a viewing adjustment method that provides a smooth transition between ambient lighting conditions would be useful.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An application may allow an initial viewing adjustment curve set at a factory to be adjusted by a user, and the adjustment may pull the viewing adjustment curve in a particular direction as desired by a user, but may not result in a multi-step, jerky viewing adjustment curve. The curve of the viewing adjustment curve may remain a curve, but, through the use of regions and smoothing, the viewing adjustment curve may retain its curve design, resulting in a smooth transition of display levels in response to varying conditions.

SPECIFICATION

Although the following text sets forth a detailed description of numerous different embodiments, it should be understood that the legal scope of the description is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
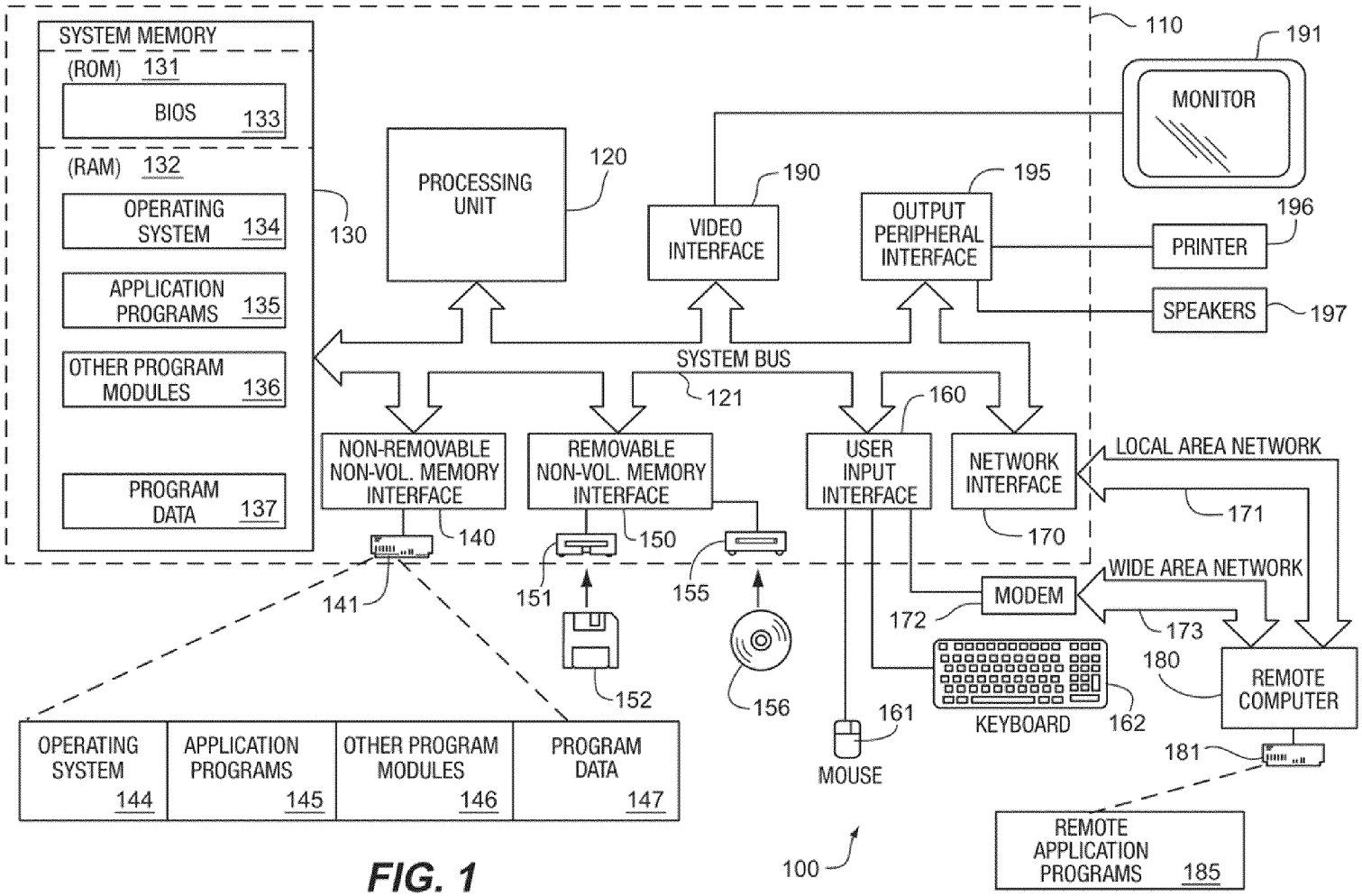
FIG. 1 is an illustration of a computing device.

FIG. 1 illustrates an example of a suitable computing system environment 100 that may operate to execute the many embodiments of a method and system described by this specification. It should be noted that the computing system environment 100 is only one example of a suitable computing environment and is not intended to suggest any limitation as to the scope of use or functionality of the method and apparatus of the claims. Neither should the computing environment 100 be interpreted as having any dependency or requirement relating to any one component or combination of components illustrated in the exemplary operating environment 100.

With reference to FIG. 1, an exemplary system for implementing the blocks of the claimed method and apparatus includes a general purpose computing device in the form of a computer 110. Components of computer 110 may include, but are not limited to, a processing unit 120, a system memory 130, and a system bus 121 that couples various system components including the system memory to the processing unit 120.

The computer 110 may operate in a networked environment using logical connections to one or more remote computers, such as a remote computer 180, via a local area network (LAN) 171 and/or a wide area network (WAN) 173 via a modem 172 or other network interface 170.

Computer 110 typically includes a variety of computer readable media that may be any available media that may be accessed by computer 110 and includes both volatile and nonvolatile media, removable and non-removable media. The system memory 130 includes computer storage media in the form of volatile and/or nonvolatile memory such as read only memory (ROM) 131 and random access memory (RAM) 132. The ROM may include a basic input/output system 133 (BIOS). RAM 132 typically contains data and/or program modules that include operating system 134, application programs 135, other program modules 136, and program data 137. The computer 110 may also include other removable/non-removable, volatile/nonvolatile computer storage media such as a hard disk drive 141 a magnetic disk drive 151 that reads from or writes to a magnetic disk 152, and an optical disk drive 155 that reads from or writes to an optical disk 156. The hard disk drive 141, 151, and 155 may interface with system bus 121 via interfaces 140, 150.

A user may enter commands and information into the computer 110 through input devices such as a keyboard 162 and pointing device 161, commonly referred to as a mouse, trackball or touch pad. Other input devices (not illustrated) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device may also be connected to the system bus 121 via an interface, such as a video interface 190. In addition to the monitor, computers may also include other peripheral output devices such as speakers 197 and printer 196, which may be connected through an output peripheral interface 190.

Figure 2:
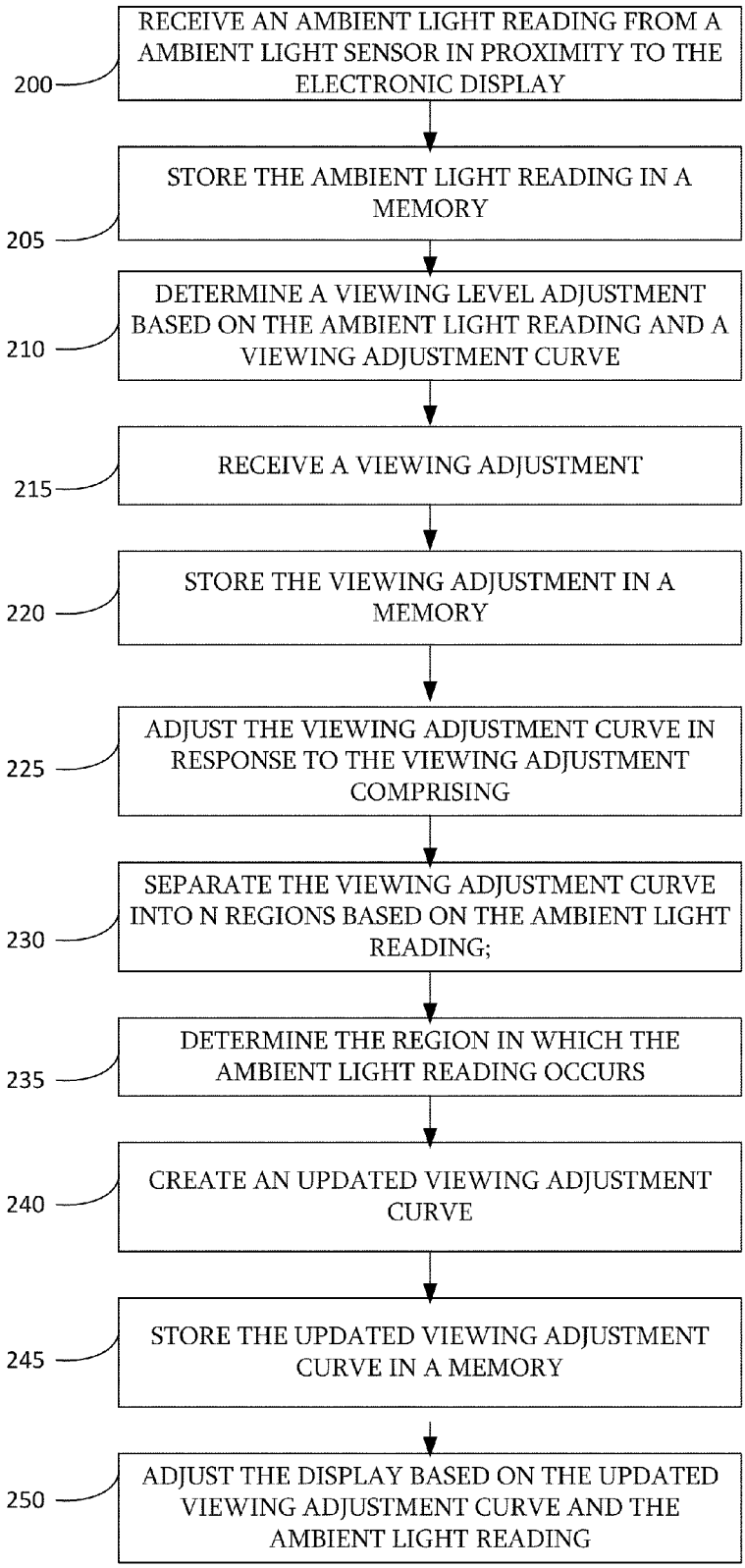
FIG. 2 is an illustration of a method adjusting viewer preferences on a display.

FIG. 2 may illustrate a method of adjusting brightness on an electronic display 191. Logically, if an electronic display is in a brighter area then it makes sense to increase the brightness of the display 191. In addition, some users like their display 191 to be brighter under a given ambient light level than other users. User-adjusted brightness settings have been available but a brightness method that provides a smooth automatic transition between user preferences for lighting conditions would be useful.

At block 200, an ambient light reading 310 may be received from an ambient light sensor in proximity to the electronic display 191. The light sensor may be part of the electronic display device 191 or may be in proximity of the computing device 110 and may communicate to the computing device 110. The ambient light reading 310 may provide a value that may be interpreted as a relative reading of the nearby ambient light. At block 205, the ambient light reading 310 may be stored in a memory.

At block 210, a viewing adjustment 320 may be determined based on the ambient light reading 310 and a viewing adjustment curve 300. The view adjustment curve 300 may take in an ambient light reading 310 and output a viewing adjustment 320 and the viewing adjustment outputs 320 may create a curve of outputs 300. The curve may be a general description of the shape of the view adjustment curve 300 versus ambient light reading 310 as the shape may take on many forms including a linear shape, a multiple curve shape, a combination of many different shapes, etc. The view adjustment 300 curve may be set at installation, may be set remotely or may be adjusted by users.

The viewing adjustment level may be an adjustment that may improve the ability to view the display 191 in a variety of ambient light readings 310. As an example, the brightness of the display 191 may be adjusted based on the ambient light reading 310. In addition, contrast, font size, font color and font bold level are additional examples (and not limitations) of levels that may be adjusted based on the ambient light reading 310. The levels of these various viewing adjustment level examples may be adjusted individually or may be adjusted together in virtually any combination.

At block 215, a viewing adjustment may be received. The adjustment may be an action by a user to adjust the viewing adjustment level 320 of one or more of the viewing adjustment level examples. The adjustments may be stored as data in a table or a database and may be graphed on the viewing adjustment curve 300 as viewing adjustment observations 331-335. At block 220, the viewing adjustments 331-335 may be stored in a memory in any appropriate form that is easily searched.

Figure 3:
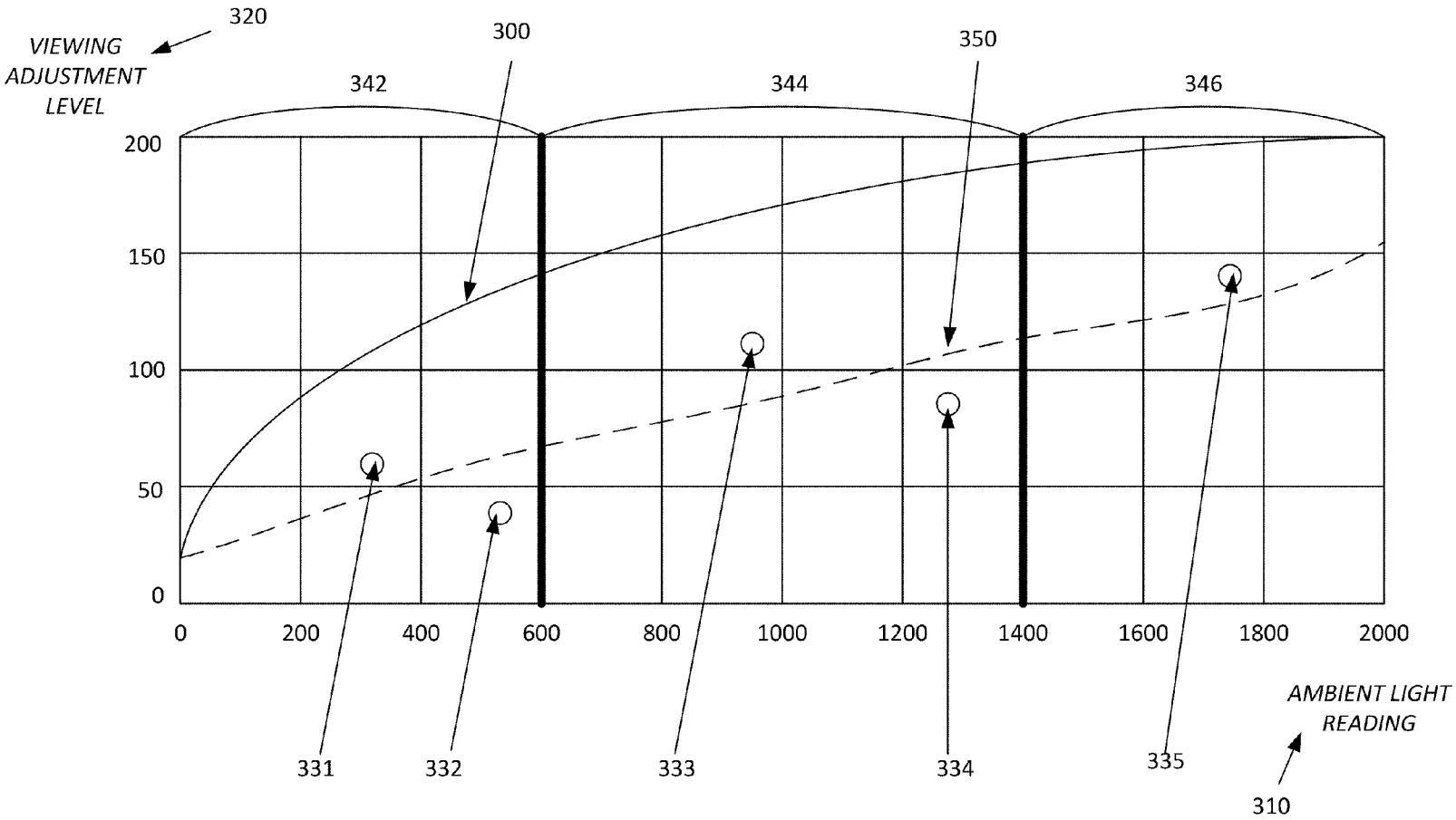
FIG. 3 is an illustration of a viewing adjustment curve and an updated viewing adjustment curve.

At block 225, the viewing adjustment curve 330 may be adjusted in response to the viewing adjustments 331-335. The adjustment may occur in a variety of ways. At block 230, in one embodiment, the viewing adjustment curve 300 is separated into n regions based on the ambient light reading. In FIG. 3, n is 3 so there are three regions 342, 344 and 346. The regions may ensure that the adjustment curve 300 stays relatively smooth. By using regions 342, 344, 346, the adjustment curve 300 may be smooth within the regions 342, 344, 346 and smooth overall. The regions 342, 344, 346 may be of different sizes and different regions may be created based on the view adjustments 331-335 or other inputs. The different sizes and number (n) of regions may be useful as the extreme low and high ends of the ambient light spectrum may merit greater precision that comes from having smaller regions, while the middle range may benefit from a smoother experience. There may be a significant perceived difference between total darkness and almost-darkness, and similarly between full bright indoor lights and sunlight.

Of course, n may be increased but having more regions may result in decreased smoothness to adjustment curve 300 and a choppier user experience. Similarly, if there are a significant number of viewing adjustments above and below 800, different regions may be created around 800.

At block 235, the region 342, 344, 346 in which the ambient light reading occurs may be determined. The determination may be made by placing the reading in the proper region 342, 344, 346.

At block 230, an updated viewing adjustment curve 350 may be created. The updated adjustment curve 350 (dotted in FIG. 3) may adjust the viewing adjustment curve 300 in the region 342, 344, 346 toward the viewing adjustments 331-335 while maintaining the updated viewing adjustment curve 350 continuous across all regions 342, 344, 346.

The updated viewing adjustment curve 350 may be created in a variety of ways. In one embodiment, the ambient light reading 310 in the memory are used and the viewing adjustment 331-335 in the memory are used to create a regression, such as a least squares regression, to create the updated viewing adjustment curve 350. As can be seen in FIG. 3, the viewing adjustment curve 300 may be adjusted downward to fit between the viewing adjustments 331-335. In yet another embodiment, a smoothing algorithm may be used on the updated viewing adjustment curve 350 to further remove any peaks or troughs.

In yet another embodiment, the updated viewing adjustment curve 350 is averaged with the viewing adjustment curve 300 to create a new updated viewing adjustment curve. The result may be a smoother curve that is similar to the original viewing adjustment curve 300 but takes into account user preferences. In another embodiment, maximum and minimum values may be calculated for the viewing adjustment curve 300 in each region 342, 344, 346 based on the surrounding regions wherein the maximum and minimum values for the viewing adjustment curve 300 in a first region are within a predetermined percentage of the surrounding regions. In this way, the curve will not make large leaps when moving from region to region.

The updated viewing adjustment curve 350 may have n regions 342, 344, 346 and may have n data points, one for each region 342, 344, 346. The updated viewing adjustment curve 350 may be determined in a way to fit each data point into its own region 342, 344, 346. In another embodiment, each region 342, 344, 346 may require at least two data points. At block 245, the updated viewing adjustment curve 350 may be stored in a memory.

At block 250, the display on the electronic display 191 may be adjusted based on the updated viewing adjustment curve 350 and the ambient light reading 310. It should be noted that the updated viewing adjustment curve 350 may be determined for each user. The updated viewing adjustment curve 350 may be stored for each user and may be retrieved automatically and may be updated automatically. In some embodiments, the updated viewing adjustment curve 350 is stored remotely, such as in an electronic cloud, and whenever a user logs into the cloud, the updated viewing adjustment curve 350 for the user may be retrieved.

The updated viewing adjustment curve 350 may also be stored as metadata to a file and whenever that file is opened, the viewing adjustment curve 300 on the device in question may be replaced with the updated viewing adjustment curve 350 stored in the metadata. Of course, a different updated viewing adjustment curve 350 may be stored for each device, each application, each condition, etc. The updated viewing adjustment curve 350 may be given names and may be retrieved by a user. For example, a user may have an updated viewing adjustment curve 350 when trying to save batteries which may be different than a curve when the computing device 110 is plugged in. The updated viewing adjustment curve 350 may be a separate file and may be communicated from device to device and user to user.

Figure 4:
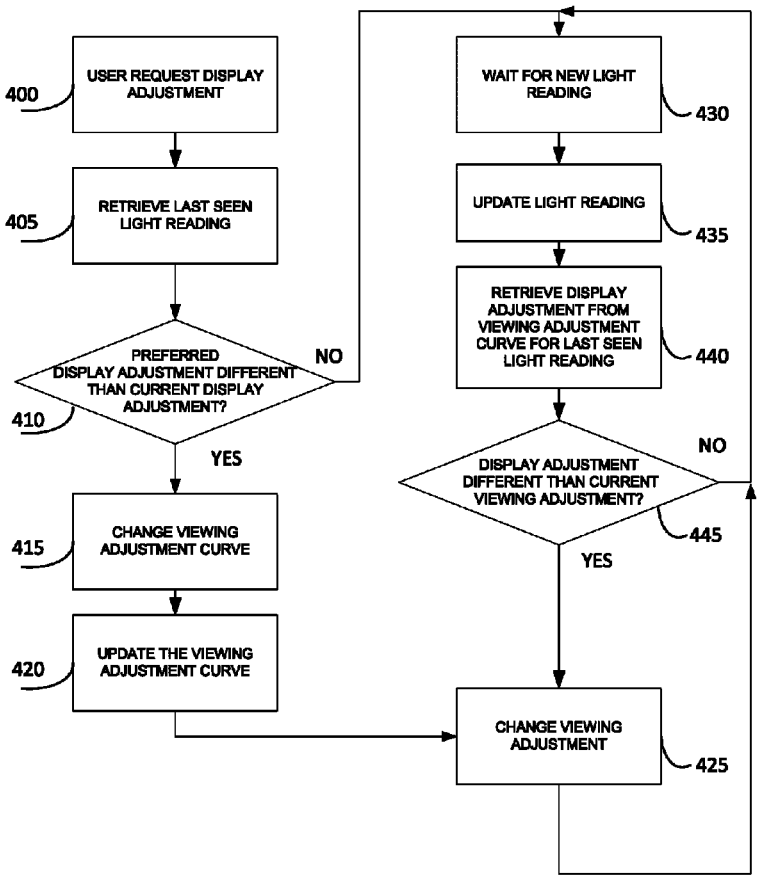
FIG. 4 is an illustration of another embodiment of adjusting viewer preferences on a display.

FIG. 4 may illustrate another example of adjusting a display 191. At block 400, a user may request a display 191 adjustment. The adjustment may be as simple as pressing a brightness button or may be more complicated such as sharpening a photo. At block 405, the last received ambient light reading 310 may be retrieved from a memory. At block 410, it may be determined whether the preferred display adjustment is different than the current display adjustment. If the adjustment, is large enough or far enough from the current adjustment curve, at block 415, the viewing adjustment curve 350 may be adjusted in the direction of the user input. At block 420, the viewing adjustment curve 350 may be updated. At block 425, the new viewing adjustment curve 350 may be used to adjust the display at block 425. The method may then continue at block 430 by waiting for another ambient light reading 310.

Referring again to block 410, if the adjustment is not large enough to require an adjustment, the method may pass control to bloc 430 where another ambient light reading may be received.

From block 430, control may pass to block 435 where the most recent ambient light reading 310 may be updated. At block 440, a display adjustment based on the viewing adjustment curve 350 may be retrieved. At block 445, the method may determine if the display adjustment 350 is different than a current viewing adjustment. If there is no adjustment required, control may pass to block 430 where the method may wait for a new ambient light reading and the method may repeat. If at block 445 it is determined that the display adjustment is different than the current display adjustment, then at block 425, the change viewing adjustment may be made.

Figure 5:
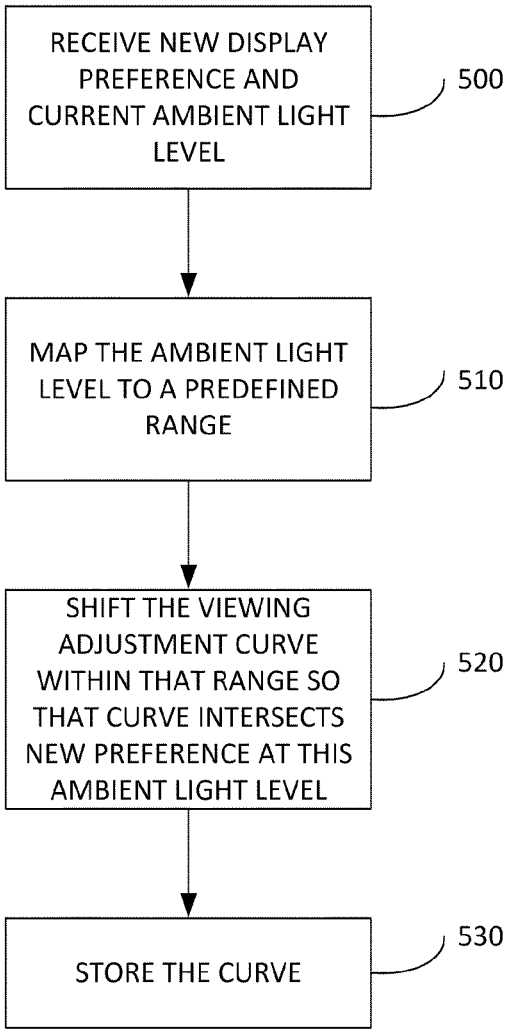
FIG. 5 is an illustration of adjusting a display adjustment curve.

FIG. 5 may illustrate another method of adjusting the viewing adjustment curve 350. At block 500, a new viewing adjustment level preference 320 and a current ambient light level 310. At block 510, the ambient light level 310 may be mapped to a predefined range such as the ranges 343, 344, 346. At block 520, the viewing adjustment curve 520 may be adjusted within that range (342, 344, 346) such that the curve 350 intersects the new preference point 331-335 at this ambient light level 310. In this manner, the curve will directly relate to the user preferences. At block 530, the curve may be stored or updated and available for future use.

In action, an initial viewing adjustment curve 300 set at a factory may be adjusted by a user, and the adjustment may pull the viewing adjustment curve 300 in a particular direction, but may not result in a multistep, jerky viewing adjustment curve. The curve of the viewing adjustment curve 300 may remain a curve, but, through the use of regions and smoothing, the viewing adjustment curve 300 may retain its curve design. A user will notice that the display 191 will adjust in a manner that takes into account previous adjustments by the user, thus saving the user time from having to make additional adjustments, saving the users time and improving the user experience.

In conclusion, the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The invention claimed is:

1. A method of adjusting a display brightness level of an electronic display in communication with a computing device comprising:

receiving sensed ambient light brightness values according to readings from an ambient light sensor in proximity to the electronic display;

setting the display brightness level to target display brightness values determined based on the sensed ambient light brightness values and based on a brightness adjustment curve, the brightness adjustment curve mapping a set of light brightness values to a set of display brightness values, including mapping the sensed ambient light brightness values to the target display brightness values, the set of display brightness values including default display brightness values, the default display brightness values comprising values that have not been set according to a user preference;

receiving an inputted display brightness value inputted by a user and in response:

storing the inputted display brightness value in a memory of the computing device and setting the current value to the inputted display brightness value;

obtaining a current ambient light brightness value according to a reading from the ambient light sensor; and adjusting the brightness adjustment curve by:

determining target light brightness values in the adjustment curve according to the current ambient light brightness value and changing corresponding target display brightness values based on the inputted display brightness value, the target display brightness values comprising at least a first portion of the default display brightness values, the adjusted brightness adjustment curve mapping the target light brightness values to the target changed display brightness values, the adjusted brightness adjustment curve continuing to comprise at least a second portion of the default brightness values; and storing the adjusted brightness adjustment curve and continuing using the updated brightness adjustment curve in the setting the display brightness level.

2. The method of claim 1, further comprising using a smoothing algorithm on the adjusted brightness adjustment curve.

3. The method of claim 2, further comprising using the current ambient light brightness value reading in the memory to create a regression used in calculating the updated brightness adjustment curve.

4. The method of claim 3, wherein the plurality of display brightness values are computed by averaging display brightness values of the brightness adjustment curve.

5. The method of claim 3, further comprising calculating a maximum value and a minimum value for the brightness adjustment curve in a region of the brightness adjustment curve based on surrounding regions wherein the maximum value and the minimum value for the viewing adjustment curve in the region are within a predetermined percentage of the surrounding regions.

6. The method of claim 1, further comprising storing user identifiers and creating an updated brightness adjustment curve for each user.

7. The method of claim 1, wherein the brightness adjustment curve comprises n regions are different sizes.

8. The method of claim 7, wherein the brightness adjustment curve with the n regions has n data points, one associated with each region and the updated brightness adjustment curve is made to fit each data point.

9. A computer storage device comprising computer executable instructions for adjusting brightness on an electronic display in communication with a computing device, the computer executable instructions comprising computer executable instructions for:

receiving an ambient light reading from an ambient light sensor in proximity to the electronic display;

storing the ambient light reading in a memory;

determining a viewing adjustment level based on the ambient light reading and a brightness adjustment curve, the brightness adjustment curve mapping a set of ambient light readings to a set of brightness values of the electronic display, the set of brightness values including default brightness values;

receiving a brightness adjustment input inputted by a user;

storing the brightness adjustment input in a memory;

responsive to receiving the brightness input adjustment, adjusting the brightness adjustment curve by:

separating the brightness adjustment curve into n regions based on the ambient light reading;

determining an appropriate region wherein the appropriate region comprises a region of the n regions in which the ambient light reading occurs;

adjusting the brightness adjustment curve in the appropriate region by changing some of the brightness values such that they move toward the brightness input, the changed brightness comprising a first portion of the default brightness values, and wherein a second portion of the default brightness values are not changed;

storing the updated brightness adjustment curve in a memory; and adjusting brightness of the electronic display based on the updated brightness adjustment curve and another ambient light reading by, according to the updated brightness adjustment curve, mapping the other ambient light reading to one of the moved brightness values.

10. The computer storage device of claim 9, further comprising computer executable instructions comprising a smoothing algorithm that is used to move the some of the brightness values.

11. The computer storage device of claim 10, further comprising computer executable instructions create a regression used to move the some of the brightness values.

12. The computer storage device of claim 11, further comprising computer executable instructions that average the updated brightness adjustment curve and the brightness adjustment curve to create a new updated brightness adjustment curve and using the new updated brightness adjustment curve to adjust the brightness of the electronic display.

13. The computer storage device of claim 11, further comprising computer executable instructions that calculate a maximum value and a minimum value for the brightness adjustment curve in each region based on regions surrounding the appropriate region, wherein the maximum value and the minimum value for the brightness adjustment curve in the appropriate region are within a predetermined percentage of the surrounding regions.

14. The computer storage device of claim 9, further comprising computer executable instructions for storing a user identifier and creating the updated brightness adjustment curve for each user.

15. The computer storage device of claim 9, wherein the n regions are different sizes and wherein the brightness adjustment curve with the n regions has n data points, one associated with each region and the updated brightness adjustment curve is fitted to each data point.

16. A method, performed by a computing device, of adjusting a current display brightness level of a display, the computing device comprising a light sensor and storage, the method comprising:

accessing a brightness map in the storage, where the brightness map maps light brightness values to display brightness setting values, the light brightness values comprising values of brightness of light, the display brightness setting values initially comprising default values of brightness levels of the display;

monitoring ambient light readings from the light sensor and according thereto, when a new ambient light level is detected from the ambient light readings: using the brightness map to map the new ambient light level to a target display brightness setting value, and setting the current display brightness value according to the target display brightness setting value;

responsive to a user manually setting the current display brightness level to a new value: obtaining a current ambient light brightness value according to the light sensor, based on the obtained current ambient light brightness determining a target range of the light brightness values and updating the brightness map such that the brightness map maps the target range of the light brightness values to new display brightness level values that correspond to the target range of the light brightness values, the new display brightness level values including the display brightness level set by the user, wherein the adjusted brightness map continues to map a portion of the light brightness values to a portion of the default values of brightness levels of the display.

17. A method according to claim 16, further comprising smoothing the brightness map by recomputing brightness setting values of the brightness map in a local neighborhood of the new display brightness level value, the local neighborhood comprising the target range of the light brightness values.

18. A method according to claim 16, further comprising identifying the local neighborhood according to a predefined range.

19. A method according to claim 16, wherein prior to computing the new value, the brightness map maps the current ambient light brightness value to a default display brightness value.

* * * * *